US005854773A

United States Patent [19]

Lee

[11] Patent Number: 5,854,773

[45] Date of Patent: Dec. 29, 1998

[54] DETACHABLE WRISTWATCH-INSTRUMENT COMBINATION

[75] Inventor: Robert M. Lee, Reno, Nev.

[73] Assignee: Hunting World Incorporated, Reno, Nev.

[21] Appl. No.: 620,652

[22] Filed: Mar. 22, 1996

[51] Int. Cl.[6] ..... G04B 37/00

[52] U.S. Cl. ..... 368/10; 368/278

[58] Field of Search ..... 368/281, 282, 368/280, 278, 10

[56] References Cited

U.S. PATENT DOCUMENTS

| | | | |
|---|---|---|---|
| 2,559,211 | 7/1951 | Brunengraber | 368/281 |
| 4,183,206 | 1/1980 | Porsche et al. | 368/14 |
| 4,483,626 | 11/1984 | Noble | 368/10 |
| 4,630,933 | 12/1986 | Horii | 368/10 |

*Primary Examiner*—Bernard Roskoski

*Attorney, Agent, or Firm*—Townsend and Townsend and Crew LLP

[57] ABSTRACT

A wristwatch, altimeter and compass are mounted in two side-by-side, releasably attached frames at least one of which has an arm band for carrying them on a wrist. One of the frames has two subframes for mounting the wristwatch and the compass. Flat, straight-edged flanges project from opposing peripheries of the frames and include a tongue and groove connection so that the frames, and therewith the watch and instrument contained therein, can be separated from or secured to each other by slidably moving the groove and tongue connection of the flanges into and out of engagement. A spring-biased locking member is pivotally mounted on the flange forming the groove for movement between an open and a closed position. In the closed position, the locking member prevents detachment of the groove and tongue connection. The locking member includes a plug which extends into the groove when the member is in its locking position so that the member must first be axially moved before it can be pivoted into its unlocked position to prevent an unintended opening of the lock.

18 Claims, 4 Drawing Sheets

DETACHABLE WRISTWATCH-INSTRUMENT COMBINATION

BACKGROUND OF THE INVENTION

The present invention relates to a wristwatch combined with one or more instruments.

Instruments, such as a compass or an altimeter, for example, are needed, or at least desirable, for certain activities such as backpacking, climbing, flying and the like for knowing altitude, direction or other useful and/or necessary information. Although such instruments are widely available and extensively used, each is typically carried separately of the other and, when needed, might be difficult to find or retrieve.

Wristwatches are almost universally worn because, when strapped to one's wrist, they are instantaneously and without searching accessible, while during nonuse they are carried without burdening or requiring the attention of the user. It is, of course, possible to use instruments such as altimeters or compasses in the same manner by suitably strapping them to one's arm. However, a watch and multiple similar-looking instruments strapped to one's arm are unsightly, they are necessarily spaced apart relatively widely so that they extend a long distance up the forearm, and when long-sleeved clothing is worn they become increasingly inaccessible because more and more of the sleeve must be pulled back to gain access to the instrument, which may at least be impractical in inclement weather. Thus, while most persons wear watches, sometimes with multiple functions, instruments of the type mentioned above are carried separately in bags, pockets or the like.

SUMMARY OF THE INVENTION

The present invention advantageously and attractively combines a wristwatch with one or more instruments so that the combination, as a unit, can be strapped onto a wearer's wrist where needed. The watch and instrument are detachably locked to each other so that, when there is no need for the instrument, the watch can be worn by itself in a conventional manner.

This is accomplished by providing two, generally tubular, cylindrically shaped frames which define interior spaces into which a watch module (meaning a watch which is self-contained in a housing but including within this definition all the components of a watch even if not contained in a separate housing) and an instrument module (meaning an instrument which is also self-contained in a housing but including within this definition all the components of the instrument even if not contained in a separate housing) can be placed. The frames preferably have flat, plate-shaped flanges which project from respective peripheries of the frames and which form a releasable tongue and groove connection so that the frames can be attached to each other by sliding the tongue on one of the flanges into an appropriately shaped groove in the other one of the flanges.

A locking mechanism is provided to prevent an unintended separation of the two frames once they are connected. Preferably, it is formed by a locking member mounted to one of the frames which can be pivoted between a locking position, in which the tongue and groove connection between the flanges cannot be separated, and an unlocked position, in which they can be separated by sliding the tongue out of the groove.

In a presently preferred embodiment, one of the frames is defined by two concentric subframes which are hingedly attached to each other. Each of the subframes defines an interior, open space into which the watch module and one instrument module, or two instrument modules, for example, can be placed. An easily manipulated snap-in lock retains the two subframes closed; that is, concentrically aligned, so that, in such position, the watch is preferably visible while the instrument disposed beneath it is hidden. When access to the instrument is needed, the snap connection is released and the top subframe is pivoted open so that the instrument can be viewed.

DESCRIPTION OF THE PREFERRED EMBODIMENTS

Figure 1:
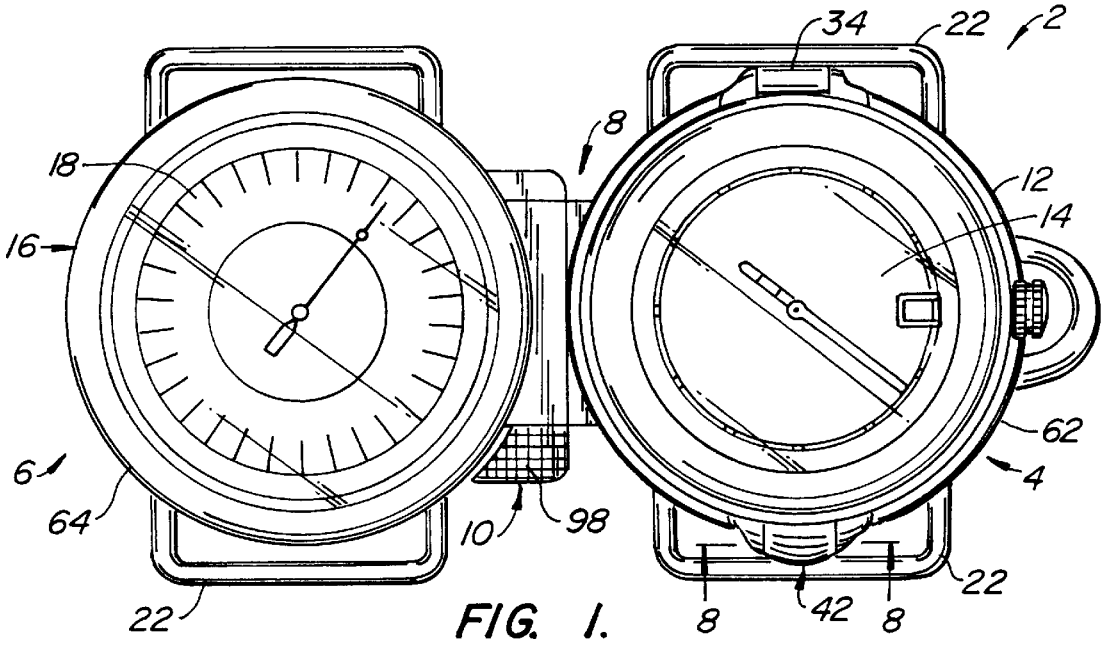
FIG. 1 is a plan view of a wristwatch-instrument combination constructed in accordance with the present invention.
Figure 2:
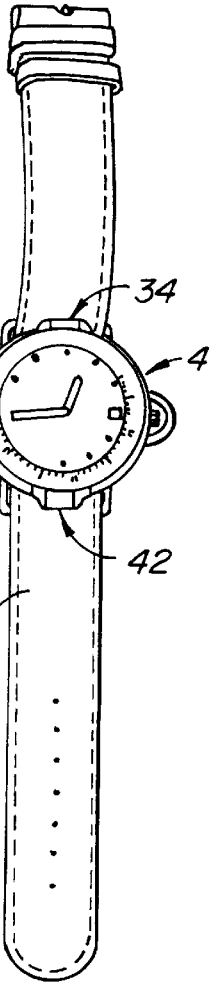
FIG. 2 is a plan view of the watch portion only of the combination shown in FIG. 1 and includes a conventional wristwatch band for attaching the watch to the wrist of a wearer.

Referring initially to FIGS. 1 and 2, a wristwatch-instrument combination 2 constructed in accordance with the present invention comprises a watch unit 4 and an instrument unit 6 detachably secured to each other by a releasable connection 8 having a locking mechanism 10. The watch unit 4 is defined by a generally cylindrical, tubular frame 12 which holds a watch module 14. The instrument unit 6 is similarly defined by a generally cylindrical, tubular instrument frame 16 which holds an instrument module 18 such as a self-contained altimeter. A band 20, such as a conventional wristwatch band, is looped through or about a pair of U-shaped band holders 22 which project in opposite directions from a periphery 62 of the watch frame as is shown in FIG. 2. Instrument frame 16 preferably also includes band holders 22 so that a band can be separately attached to it (not illustrated) for separately wearing the instrument unit on a wrist like a wristwatch should that become desirable.

For everyday use of the watch only, locking mechanism 10 is opened and the watch unit is separated from the instrument so that it appears as illustrated in FIG. 2. When, for example, during a mountain backpacking or climbing trip it is desired to have the altimeter readily accessible, the instrument unit 6 is attached to the watch unit 4 so that the two appear as illustrated in FIG. 1. The combination is then strapped to the person's wrist (not shown) with band 20 so that the two units are closely adjacent each other oriented parallel to the wearer's forearm (not shown).

Figure 9:
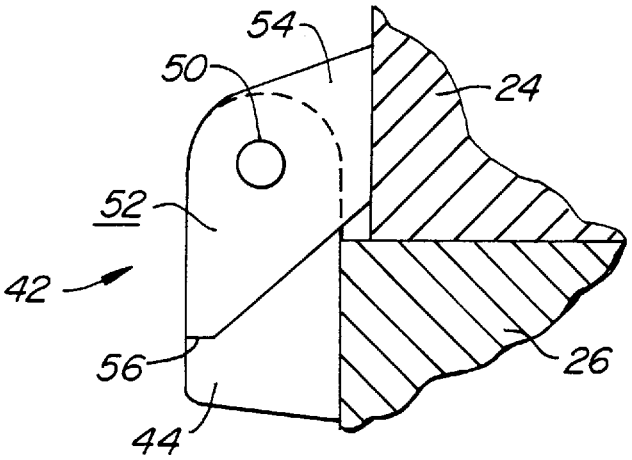
FIG. 9 is a fragmentary, side elevational view, in section, and is taken on line 9—9 of FIG. 8.
Figure 10:
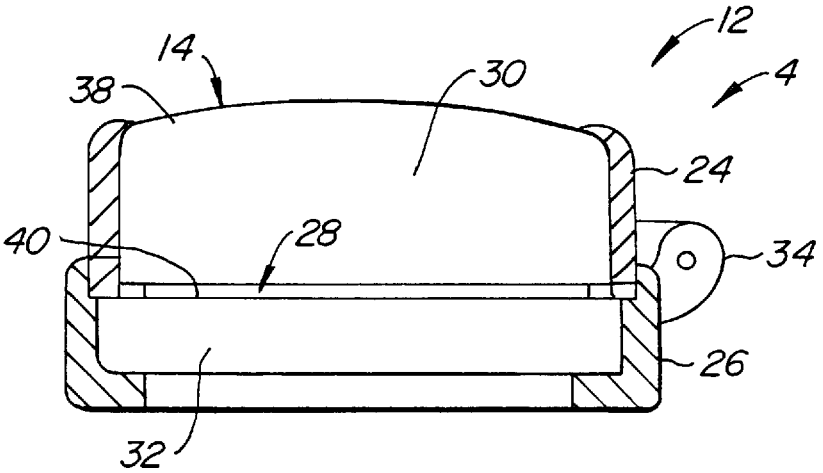
FIG. 10 is a side elevational view, in section, showing a frame defined by two, pivotally connected subframes holding a watch and an instrument in stacked relation.

Referring now to FIGS. 1 and 8–10, in one embodiment of the present invention, watch unit 4 is constructed of two subframes 24, 26 which hold a watch module 14 and a second instrument module 28, such as a compass, in addition to the instrument, such as an altimeter, mounted in instrument frame 16. The subframes preferably have a generally cylindrical, tubular configuration and they define interior spaces 30 and 32 formed to receive and suitably hold the watch and second instrument modules, respectively. A hinge 26 connects the subframes to each other and permits them to be pivoted from a closed position, in which they are concentric (as illustrated in FIG. 10), and an open position in which the subframes are nonconcentric; e.g. angularly inclined with respect to each other (see FIG. 3D). The watch and instrument modules are suitably and preferably removably secured to the subframes; for example, with tabs 36. Other manners of attaching the modules to the frames, such as a frictional connection (employing O-rings, for example), can be used and are well known to those of skill in the art. Alternatively, the watch and/or instrument modules can be permanently mounted in the interior spaces defined by the frames.

Each of the subframes defines at least one open end 38, 40 so that the corresponding units can be viewed and read.

During regular use, the subframes are maintained in their closed position (as shown in FIG. 10) with a snap-lock 42 defined by a pair of spaced-apart flanges 44 located opposite hinge 34 and which hold balls 46 biased by compression springs 48 into detents 50 on sides 52 of a snap arm 54. The snap arm projects from the periphery of upper subframe 24 while flanges 44 project from the periphery of the lower subframe 26. The snap arm includes a lower edge 56 which is spaced outwardly from the periphery of the subframes, as best seen in FIG. 9, so that it can be readily grasped with a finger or fingernail of the user. By applying an upward pressure (as seen in FIG. 9), the holding force exerted by the spring-biased balls 46 is comfortably overcome so that the upper subframe can be pivoted into its open position to enable viewing of the second instrument module 28 through opening 40 of the lower subframe.

Referring now to FIGS. 3A–7, releasable connection 8 which secures watch unit 4 to instrument unit 6 is formed by a pair of generally flat, plate-shaped flanges 58, 60 which project away from peripheries 62, 64 of the watch frame and instrument frame 12, 16, respectively.

Flange 60 projecting from the instrument unit is relatively thick and defines a blind hole 66 which extends from an open end thereof over most of the length of the flange. It is spaced inwardly from an edge 70 of the flange and communicates therewith via an open, elongated slot 68.

Flange 58 projecting from the periphery 62 of watch frame 12 is relatively thin and has a bulbous end 72 which is dimensioned so that it can be slidably inserted into blind hole 66. A connecting portion 74 of the flange between its bulbous end and the periphery of the watch frame is dimensioned so that it fits snugly through slot 68 in flange 60.

To attach instrument frame 16 to watch frame 12, the bulbous end of flange 58 is aligned with blind hole 66 and connection portion 74 of flange 58 is aligned with slot 68. Once aligned, the bulbous end and the connecting portion are pushed into the blind hole and the slot, respectively, to complete the connection of the watch unit to the instrument unit. By virtue of the snug engagement of the hole and the slot by the bulbous end and the connecting portion, the watch and instrument units are substantially immovably secured to each other, except that axial movement is possible to disengage the two when this is desired.

An unintended separation of the watch and instrument units is prevented by locking mechanism 10. Referring particularly to FIGS. 1 and 3–7, the locking mechanism includes a pivotable locking member 76 and a shaft 78 one end of which is threaded into the locking member. Another end of the shaft is defined by an enlarged diameter head 80, which may include a slot 82 for tightly screwing the shaft into the locking member, and which is slidable in an aperture 84 formed in flange 60 of the instrument unit 6. The aperture is parallel to and laterally offset from blind hole 66.

A bushing 86 slidably engages shaft 78, is disposed in aperture 84, and locked in position proximate an open end of the aperture by a set screw 88. A compression spring 90 is disposed between the bushing and shaft head 80 and biases the latter into the aperture until a face 92 of the locking member abuts side 94 of flange 60.

To install, the locking mechanism, spring 90 and bushing 86 are slipped over shaft 78 and the shaft is then securely threaded into the locking member 76. The shaft and the bushing are next slipped into aperture 84 until face 92 abuts flange side 94. Set screw 88 is then tightened to lock the bushing in the aperture and thereby secure the locking mechanism to the flange. To remove the locking mechanism, the set screw is backed up to free the bushing so that it, together with the spring and the shaft, can be withdrawn from the aperture.

Figure 3A:
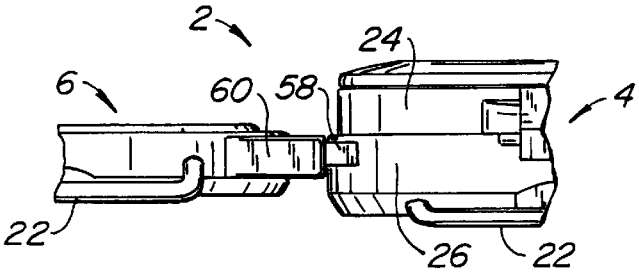
FIG. 3A is a fragmentary, front elevational view of the wristwatch-instrument combination shown in FIG. 1.
Figure 3B:
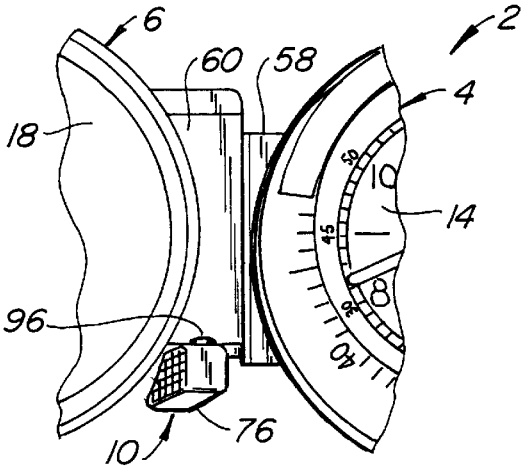
FIG. 3B is a fragmentary plan view of the same combination illustrating a partial separation of the connection between the wristwatch and the instrument portion of the combination.
Figure 3C:
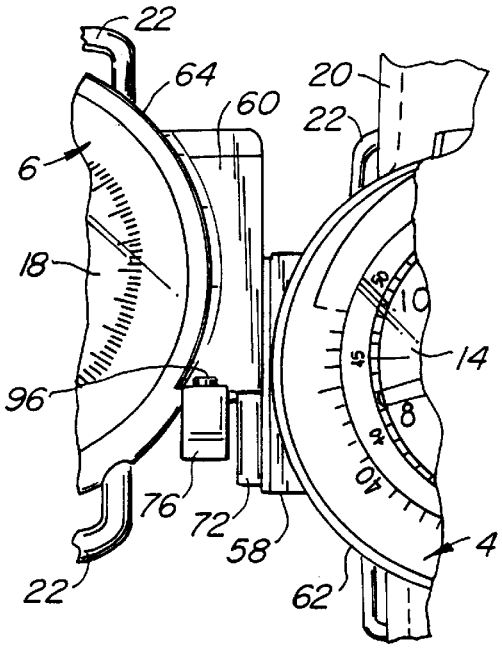
FIG. 3C is a view similar to FIG. 3B and shows the instrument in the process of being detached from the watch.
Figure 3D:
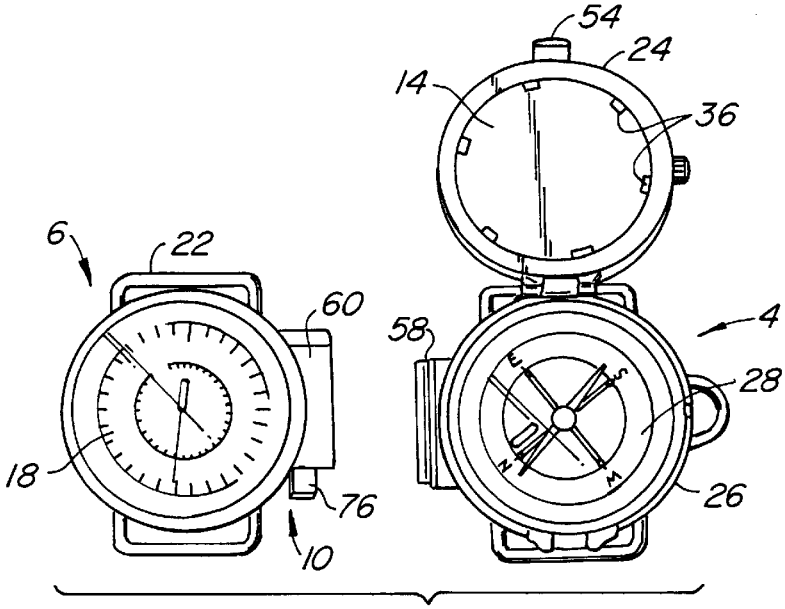
FIG. 3D shows the watch and instrument portions of the combination separate and illustrates a frame formed by two subframes mounting a watch and an instrument.
Figure 4:
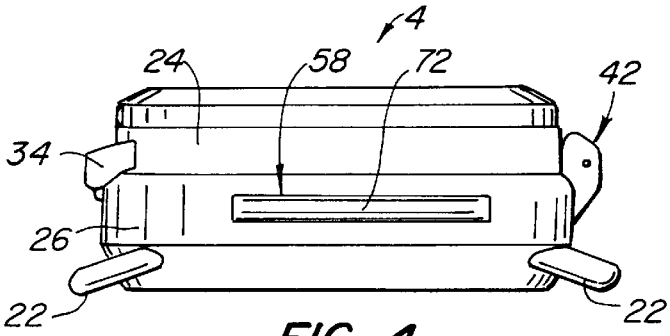
FIG. 4 is a side elevation of a frame having subframes mounting a wristwatch and an instrument.
Figure 5:
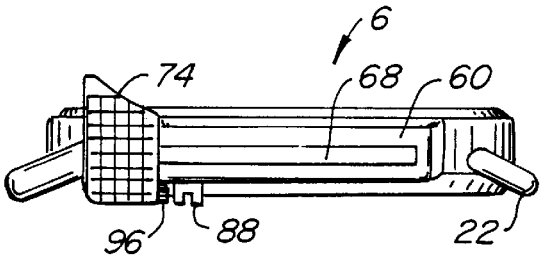
FIG. 5 is a side elevation of the instrument portion of the combination shown in FIG. 1.
Figure 6:
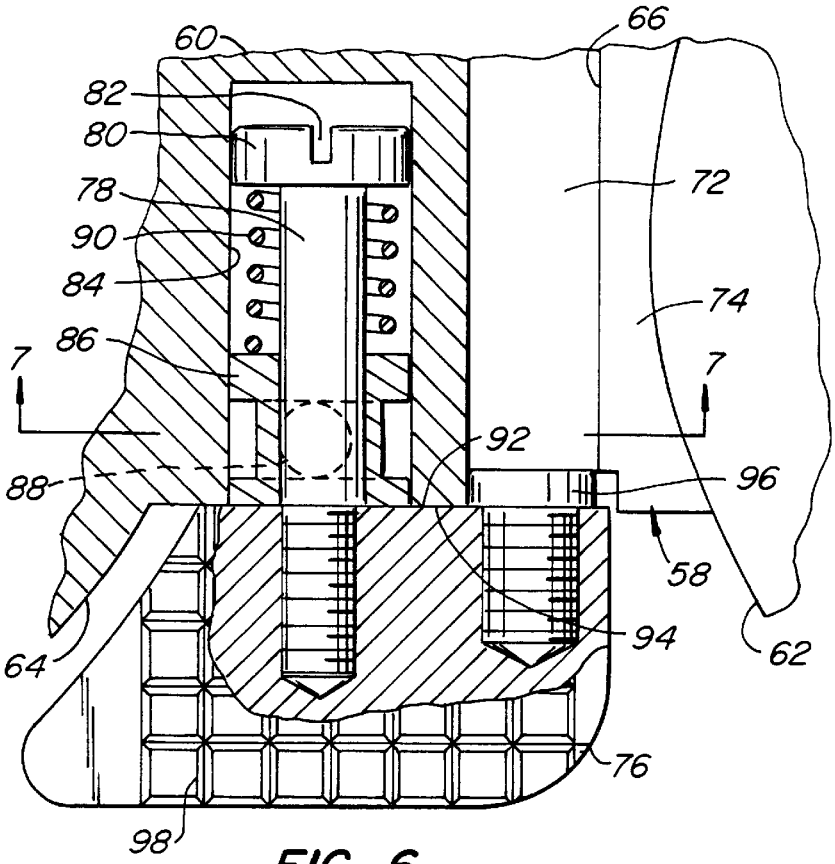
FIG. 6 is an enlarged, fragmentary plan view, in section, which illustrates the releasable connection between the two frames housing the watch and an instrument, respectively.
Figure 7:
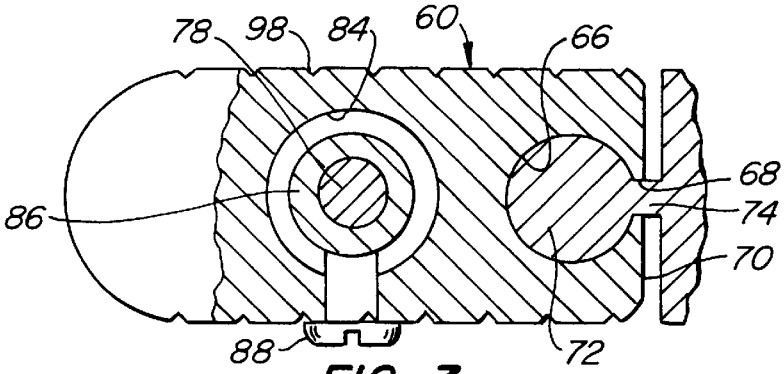
FIG. 7 is a fragmentary, front elevational view, in section, and is taken on line 7—7 of FIG. 6.
Figure 8:
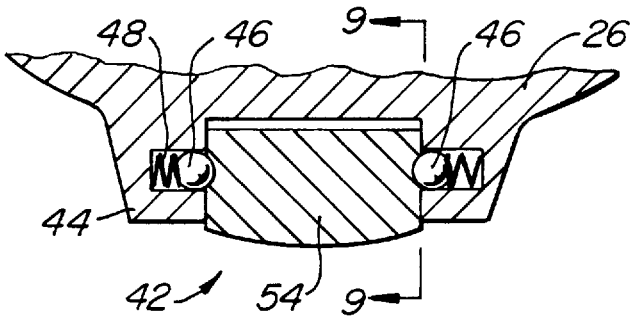
FIG. 8 is a fragmentary, front elevational view, in section, and is taken on line 8—8 of FIG. 1.

Further, an antipivoting plug 96 is threaded into or otherwise secured to the locking member at a location in which the plug is concentric with hole 66 receiving the bulbous end 72 of watch unit flange 58 when the member is in its locked position. When the plug is aligned with hole 66, spring 90 biases the plug into the hole until face 92 abuts flange side 94. In this position the locking member is fixed and cannot be pivoted about the axis of shaft 78 to prevent an unintended pivotal movement of the locking member and a possible unintended separation of the watch and instrument units. When the two units are to be separated, locking member 76 is grasped, and it includes surface grooving 98 to facilitate this, pulled axially (with respect to shaft 78) out of aperture 84 until plug 96 clears hole 66, and is then pivoted about the axis of shaft 78 until it clears hole 66, as is illustrated in FIG. 3C. The watch and instrument units 4, 6 can now be separated by sliding bulbous end 72 out of hole 66.

What is claimed is:

1. A wristwatch-instrument combination comprising first frame including a watch module and second frame adapted to receive an instrument module, respectively; means for securing the frames to each other generally side-by-side so that the frames are substantially immovable relative to each other, the securing means comprising first and second flanges projecting from the frames and defining a tongue and groove connection permitting slidable movements of the flanges relative to each other between an attached position in which the frames are substantially rigidly secured to each other and a detached position in which the frames are separate from each other while preventing pivoting movements of the flanges relative to each other, and including a lock for releasably locking the flanges to each other in the attached position; and means attached to at least one of the frames for attaching a band to the at least one frame for wearing the combination on a wrist.

2. The combination of claim 1 wherein the tongue and groove connection is defined by a blind bore in the first flange having an open end spaced inwardly from an edge of the flange and communicating with the edge of the flange via a slot defined by opposing, spaced-apart sides extending substantially over a length of the bore, and a bulbous portion dimensioned to be slidably inserted into the bore and a plate-shaped connecting section extending from an associated frame to the bulbous portion and sized to extend through the slot when the bulbous portion is disposed in the bore, the connecting section being dimensioned to engage the sides of the slot to thereby substantially immovably secure the frames to each other when the bulbous portion is fully disposed in the bore and the plate section extends through the slot.

3. The combination of claim 2 wherein the lock releasably locks the flanges to each other when the bulbous portion is fully inserted in the bore.

4. The combination of claim 1 wherein the instrument module comprises an altimeter.

5. A wristwatch-instrument combination comprising first frame including a watch module and second frame adapted to receive an instrument module, respectively; means for securing the frames to each other generally side-by-side so that the frames are substantially immovable relative to each other, the securing means comprising first and second flanges projecting from the frames and defining a tongue and groove connection permitting slidable movements of the flanges relative to each other between an attached position in which the frames are substantially rigidly secured to each other and a detached position in which the frames are separate from each other while preventing pivoting movements of the flanges relative to each other, wherein the tongue and groove connection is defined by a blind bore in the first flange having an open end spaced inwardly from an edge of the first flange and communicating with the edge of the first flange via a slot defined by opposing, spaced-apart sides extending substantially over a length of the bore, and a bulbous portion dimensioned to be slidably inserted into the bore and a plate-shaped connecting section extending from an associated frame to the bulbous portion and sized to extend through the slot when the bulbous portion is disposed in the bore, the connecting section being dimensioned to engage the sides of the slot to thereby substantially immovably secure the frames to each other when the bulbous portion is fully disposed in the bore and the plate section extends through the slot, the securing means including a lock for releasably locking the flanges to each other in the attached position when the bulbous portion is fully inserted in the bore; and means attached to at least one of the frames for attaching a band to the at least one frame for wearing the combination on a wrist; wherein the lock is attached to one of the flanges for movement between a first position in which the lock permits movement of the bulbous member in and out of the bore and a second position in which relative movements of the bulbous member in and out of the blind bore are prevented.

6. The combination of claim 5 including means securing the locking member to the first flange and permitting pivotal movement of the member between its first and second positions about an axis substantially parallel to an axis of the blind bore.

7. The combination of claim 6 including means operatively coupled with the first flange and the locking member requiring nonpivotal movement of the locking member from the second position before the locking member can be pivotally moved into its first position.

8. The combination of claim 7 wherein the nonpivotal movement is a linear movement parallel to an axis of the blind bore.

9. The combination of claim 8 including a spring biasing the locking member parallel to the axis of the blind bore towards a blind end thereof.

10. The combination of claim 9 wherein the locking member has a part overlying the blind bore when the locking member is in its second position and wherein the means requiring nonpivotal movements comprises a plug projecting from the part into the blind bore when the locking member is in its second position.

11. The combination of claim 9 wherein the locking member includes a mounting shaft extending into an aperture in the first flange, and wherein the spring is disposed in the aperture and is operatively coupled to the shaft and the flange.

12. The combination of claim 11 wherein the aperture terminates in a closed end, and including a bushing disposed in the aperture and in slidable engagement with the shaft, means releasably securing the bushing to the first flange at a location proximate an open end of the aperture, and wherein the spring engages a bushing and an end of the shaft proximate the closed end of the aperture.

13. The combination of claim 12 wherein the first and second flanges project from and are attached to the first and second frames, respectively.

14. A wristwatch-instrument combination comprising first and second frames, each frame having a periphery, an interior space and at least one open end; a watch module disposed in the inner space of one of the frames and visible through the open end thereof; an instrument module disposed in the inner space of another one of the frames and visible through the open end thereof; a blind bore having an open end formed on the periphery of the first frame so that the open end is accessible from an exterior of the first frame, a slot parallel to, extending over the length of the blind bore, and communicating it with the exterior of the first frame; a connector projecting from the periphery of the second frame and having a cross-section corresponding to a cross-section of the blind bore and the slot so that the connector can be slidably inserted through the open end into the blind bore; and a locking member movable between first and second positions in which the connector is retained in the blind bore and removable therefrom, respectively.

15. A wristwatch-instrument combination comprising a first frame defining and surrounding an interior space having at least one open end; a second frame formed by first and second subframes, each subframe surrounding and defining an interior space having at least one open end, means movably connecting the subframes to each other so that they can be moved between a closed position in which the subframes are substantially concentric to each other and an open position in which the subframes are nonconcentric, and means releasably retaining the subframes in their closed position; means projecting from the peripheries of the first and second frames for detachably and substantially rigidly connecting the frames to each other in a side-by-side relationship; a locking member moveable between a first and second positions for retaining the connected frames at least one watch module and at least two instrument modules disposed in the interior spaces; and means for retaining the watch and the at least two instruments in their respective interior spaces.

16. The combination of claim 15 including a wristband for application to a wrist of a wearer of the combination, and means for detachably securing the wristband to at least one of the frames.

17. The combination of claim 15 wherein at least a portion of each of the first and second frames is tubular.

18. The combination of claim 17 wherein at least a portion of each of the first and second subframes is tubular.

* * * * *